United States Patent [19]

Hendrick et al.

[11] Patent Number: 5,034,711

[45] Date of Patent: Jul. 23, 1991

[54] DIELECTRIC RESONATOR SUPPORT SYSTEM FOR A WAVEGUIDE

[75] Inventors: Louis W. Hendrick, Hermosa Beach; David S. Levinson, Woodland Hills, both of Calif.

[73] Assignee: Hughes Aircraft Company, Los Angeles, Calif.

[21] Appl. No.: 468,487

[22] Filed: Jan. 23, 1990

[51] Int. Cl.[5] ..... H01P 7/10

[52] U.S. Cl. ..... 333/219.1; 333/234

[58] Field of Search ..... 333/202, 208–212, 333/219, 219.1, 227, 229, 234, 228, 230, 232, 248, 250

[56] References Cited

U.S. PATENT DOCUMENTS

| | | | |
|---|---|---|---|
| 3,522,560 | 8/1970 | Hayany | 333/202 X |
| 3,636,480 | 1/1972 | Hoeck | 333/230 |
| 3,821,669 | 6/1974 | Wuerffel | 333/230 |
| 4,319,208 | 3/1982 | de Bayser et al. | 333/204 |
| 4,560,965 | 12/1985 | Gosling et al. | 333/219 |

FOREIGN PATENT DOCUMENTS

| | | | |
|---|---|---|---|
| 0328948 | 8/1989 | European Pat. Off. | 333/227 |

*Primary Examiner*—Eugene R. LaRoche
*Assistant Examiner*—Seung Ham
*Attorney, Agent, or Firm*—Robert A. Westerlund; Steven M. Mitchell; Wanda K. Denson-Low

[57] ABSTRACT

A system for supporting a dielectric resonator in a circular waveguide. A dielectric resonator is held in its optimum position using support posts or rods. The support rods are made from a suitable dielectric material, and slip fitted in holes provided at 90° intervals around the periphery of the dielectric resonator. The support rods are affixed to the waveguie, by gluing or being screwed in place. The support rods are slip fitted such that they are allowed to expand, due to temperature, without causing stress on the dielectric resonator, thus the dielectric resonator is held in position without being affixed to its supporting structure. This is an inexpensive and simple solution to a complex problem. The support system is self-centering and free from all stress. The support system utilizes a minimum amount of supporting material which permits realization of the best unloaded Q.

6 Claims, 1 Drawing Sheet

DIELECTRIC RESONATOR SUPPORT SYSTEM FOR A WAVEGUIDE

BACKGROUND

This invention relates to dielectric resonators, and more specifically, to the mounting of dielectric resonators in a waveguide.

Waveguides are used for transmitting frequencies above 1 GHz, since coaxial cable becomes too lossy. A waveguide is a tube fabricated from one or more of the commonly known conductive metals, and is usually formed in a circular or rectangular shape. Energy, in the form of electromagnetic waves, is transmitted through the waveguide, with no electromagnetic effects being evident on the exterior of the waveguide.

A dielectric filter is provided within a waveguide by mounting one or more dielectric resonators therein. One problem with dielectric resonators is supporting them in waveguides. It is known to bond dielectric resonators to a waveguide by means of glue or adhesive. It is also known to mount dielectric resonators employing rigid supports. Both these known techniques introduces losses. Glues and adhesive absorb microwaves anhd cause appreciable loss even in the quantities used to bond a resonator in a waveguide. Rigid supports expand and contract with changes in temperature and may move the dielectric resonator or may subject it to stress. The present invention affords a simple and inexpensive solution that will maintain dielectric resonators in their desired positons without subjecting them to stress and without introducing losses that lower the Q.

SUMMARY OF INVENTION

In accordance with these and other features and advantages of the present invention, there is provided a system of dielectric resonator for a circular waveguide. A dielectric resonator is held in its optimum position using a plurality of supports posts or rods, made from a suitable dielectric material, that are affixed to the waveguide, but are loosely fitted in holes provided around the periphery of the dielectric resonator. The supports are loosely fitted such that they are allowed to expand, due to temperature, without causing stress on the dielectric resonator, thus the dielectric resonator is held in position without being affixed to its supporting sturcture. This is an inexpensive and simple soultion to a complex problem. The support system is self-centering and free from all stress. Furthermore, the support system utilizes a minimum amount of supporting material which permits realization of the best unloaded Q.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
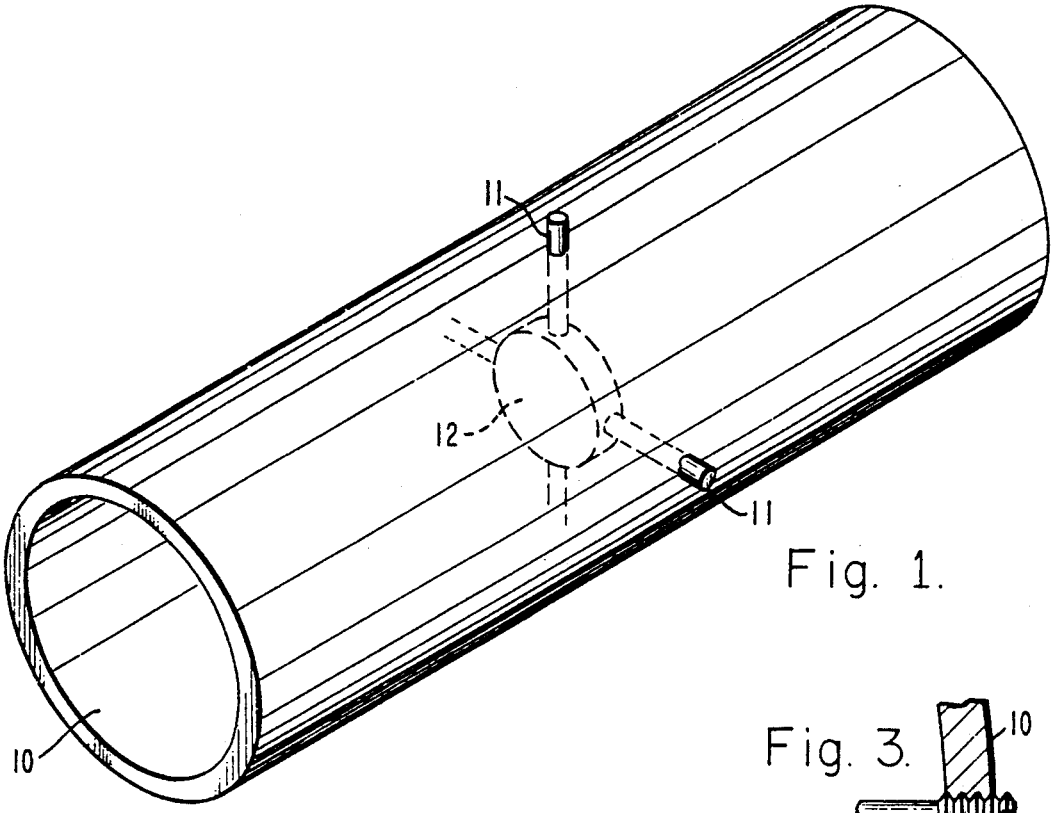
FIG. 1 is a perspective view of the exterior of a section of circular waveguide showing in phantom a dielectric resonator mounted therein by a support system employing the principles of the present invention.

Referring now to FIG. 1 which is a perspective view of circular waveguide 10, there is shown in phantom a dielectric resonator 12 mounted therein. The waveguide 10 may be constructed of a conductive metal such as aluminum, for example, and used to transmit electromagnetic waves at or above 1 GHz. Microwave filters are well known, and employ one or more resonant elements to provide bandpass or bandstop filter characteristics. One such resonant element, the dielectric resonator 12, is shown mounted in the center of the waveguide 10. The dielectric resonator 12 is "disk" or "pill" shaped and comprised of a suitable dielectric material such as a ceramic composite, for example, having a dielectric constant in the neighborhood of 35. Typically, a dielectric resonator 12 is sized according to the frequency of operation. In the range of 4.0 to 4.4 GHz, a dielectric resonator 12 is on order of 0.55 inch diameter, and a quarter inch thick. Typically, the dielectric resonator 12 may be used as an element of a waveguide filter to keep the electromagnetic waves traveling through the waveguide 10 within a desired bandpass.

Figure 2:
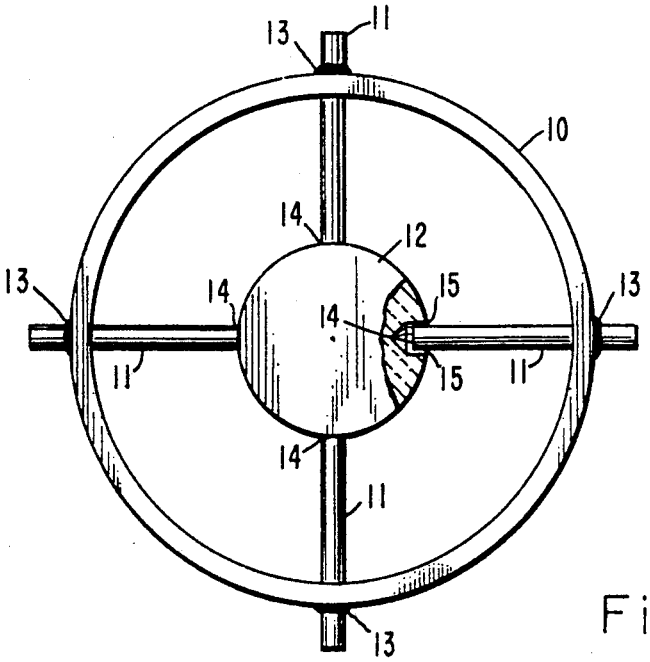
FIG. 2 is an end view looking into the waveguide of FIG. 1 and showing the dielectric resonator mounted therein.

Referring now to FIG. 2, there is shown an end view looking into the waveguide 10 and at the planar circular surface of the dielectric resonator 12. The periphery of the dielectric resonator 12 is provided with a plurality of radial holes 14 located at 90 degree intervals one from the other. A plurality of supports rods 11 are inserted through the walls of the waveguide 10 and disposed in the holes 14 located around the periphery of the dielectric resonator 12. In the embodiment of FIG. 2, the support rods 11 are affixed to the waveguide 10 by using an adhesive material 13 such as glue, for example, while being slip-fit in holes 14 located around the periphery of the dielectric resonator 12. A tolerance 15 between the diameter of the rod 11 and the diameter of the hole 14 may be less than 0.001 inch, depending on the dielectric material of the resonator 12 and support rods 11. The support rods 11 are made of a dielectric material such as Ultem 1000, for example.

By having this tolerance 15 between the support rods 11 and the holes 14, the support rods 11 are able to expand, due to heat, without causing stress on the dielectric resonator 12 and without moving the resonator 12, thus supporting the dielectric resonator 12, without being affixed to it.

The rods 11 are affixed in place outside on the waveguide 10, but no processing whatever is needed inside. The support system is self-centering and produces no stress. The glue or adhesive 12 is on the exterior of the waveguide 10, and a minimum amount of supporting material is used within the waveguide. Hence, the best unloaded Q is provided while supporting the dielectric resonator 12 at its optimum location despite variations in temperature. As stated above, the rods 11 are affixed to waveguide 10 while being slip-fit in the holes 14 disposed around the periphery of the dielectric resonator 12. The support rods 11 are located at 90 degree intervals around the circumference of the waveguide 10, as well as being disposed in the holes 14 that are located at 90 degree intervals around the periphery of the dielectric resonator 12.

Figure 3:
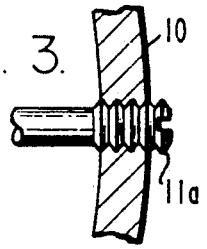
FIG. 3 is a partial end view looking at the waveguide wall showing another embodiment of a support for a dielectric resonator.

Referring now to FIG. 3 of the drawings, there is shown another embodiment of support for a resonator in which the support 11*a* is affixed of the wall of the waveguide 10 by means of screw threads instead of an adhesive.

An example filter employing the dielectric resonator support arrangement of the present invention has been constructed using circular waveguide which has an inside diameter of 1.065 inches. The filter was a bandpass filter that operated at 4.145 to 4.175 GHz and provided 30 dB attenuation at ±25 MHz from band center. The filter comprised four dielectric resonators 0.55 inch in diameter and one quarter inch thick made of Zirconium Tin Tetratitanate (ZrSn) $TiO_4$ and evenly spaced in a six inch length of waveguide. The support rods were made of Ultem 1000 three quarter inch long and one eighth inch in diameter and threaded on one end. The holes in the waveguide were tapped and the holes around the periphery of the resonators were 0.1251 inch in diameter. The tolerances for the fit of the support rods in the holes was +0.0001/-0. For this model no adhesive was used on the exterior of the waveguide. The only precaution used in assembly to properly center the resonators at the optimum position was to assure that the supports were seated in the holes but no torgue was applied. It was shown by analysis, that 0.5 inch-pounds torque could be applied without stressing the assembly. The finished filter operated as designed and had an effective linear frequency shift with temperature corresponding to −1.06 ppm/ of temperature coefficient. The Q was 7,000.

Thus there has been described a new and improved support system for a dielectric resonator in a waveguide. This inexpensive and simple solution maintains dielectric resonators in their desired positions without subjecting them to stress. A dielectric resonator is held in its optimum position using a plurality of support posts or rods, made from a suitable dielectric material, that are affixed to the waveguide, but are loosely fitted in holes provided around the periphery of the dielectric resonator. The supports are loosely fitted such that they are allowed to expand, due to temperature, without causing stress on the dielectric resonator, thus the dielectric resonator is held in position without being affixed to its supporting structure. This is an inexpensive and simple solution to a complex problem. The support system is self-centering and free from all stress. Furthermore, the support system utilizes a minimum amount of supporting material which permits realization of the best unloaded Q.

It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A waveguide resonator arrangement, comprising:

a waveguide;

a dielectric resonator disposed within said waveguide and substantially centered therewithin;

a plurality of dielectric support rods having a first portion affixed to said waveguide and a second portion disposed in a plurality of cavities provided in said dielectric resonator; and whereby said dielectric resonator is supported in said waveguide by said plurality of support rods being affixed to only said waveguide.

2. The waveguide resonator arrangement of claim 1 wherein said support rods are threaded in the exterior wall of the waveguide.

3. A waveguide resonator arrangement comprising:

a circular waveguide;

a circular dielectric resonator disposed within the circular waveguide, the resonator having a plurality of cavities at evenly spaced intervals around the periphery thereof;

a plurality of dielectric support rods affixed to the waveguide and inserted into the cavities of the resonator and wherein a clearance is provided between outer surfaces of said support rods and inner surfaces of said cavities to allow for thermal expansion of said rods within said cavities whereby said resonator is self-centering and is supported without being rigidly fixed.

4. The waveguide resonator arrangement of claim 3 wherein it comprises four of said support rods.

5. The waveguide resonator arrangement of claim 4 wherein the support rods are disposed in the dielectric resonator cavities and affixed to the circular waveguide at substantially ninety degree intervals.

6. a self-centering dielectric resonator arrangement in a circular waveguide comprising:

a circular dielectric resonator having four axial cavities spaced at ninety degree intervals around the periphery thereof; and four dielectric posts affixed to the waveguide and inserted in the axial cavities of the dielectric resonator for support thereof and having a clearance such that the dielectric resonator is self-centering without being stressed or rigidly fixed.

* * * * *